US011796185B1

(12) United States Patent
Chung

(10) Patent No.: US 11,796,185 B1
(45) Date of Patent: Oct. 24, 2023

(54) TELESCOPING VENTILATION HOOD

(71) Applicant: Katash Capital LLC, Torrance, CA (US)

(72) Inventor: Joseph Chung, Torrance, CA (US)

(73) Assignee: Katash Capital LLC, Torrance, CA (US)

( * ) Notice: Subject to any disclaimer, the term of this patent is extended or adjusted under 35 U.S.C. 154(b) by 0 days.

(21) Appl. No.: 17/664,938

(22) Filed: May 25, 2022

(51) Int. Cl.
*F24C 15/20* (2006.01)

(52) U.S. Cl.
CPC ..... *F24C 15/2092* (2013.01); *F24C 15/2035* (2013.01)

(58) Field of Classification Search
CPC ..... F24C 15/2092; F24C 15/2035
See application file for complete search history.

(56) References Cited

U.S. PATENT DOCUMENTS 369,161 A * 8/1887 Carlson ..... F24C 15/2085 126/299 D
399,430 A * 3/1889 Neef ..... F24C 15/2085 266/158
1,375,548 A * 4/1921 Barnes ..... F24C 15/2085 126/299 D
10,436,454 B2 * 10/2019 Crudo ..... F24C 15/2071
10,697,647 B1 * 6/2020 Scalf ..... F24C 15/2042
2005/0056271 A1 * 3/2005 Cheng ..... F24C 15/2078 126/299 D
2007/0079823 A1 * 4/2007 Shin ..... F24C 15/2085 126/299 D
2011/0056478 A1 * 3/2011 Chung ..... F24C 15/2085 126/299 D
2020/0107677 A1 * 4/2020 Chung ..... F24C 15/2035

FOREIGN PATENT DOCUMENTS

CN 205394527 U * 7/2016

* cited by examiner

*Primary Examiner* — Jorge A Pereiro
(74) *Attorney, Agent, or Firm* — Fox Rothschild LLP

(57) ABSTRACT

A telescoping ventilation hood device for a grill includes a hood wherein a first grease collector is attached to the hood; a telescoping tube for adjusting distance between the hood and the grill, wherein one end thereof is connected to the hood; a grease filter box connected to the other end of the telescoping tube; a filter removably received within the grease filter box in a slanted direction with respect to a gravitational direction; a secondary grease collector removably received within the grease filter box; and at least two spring balancers attached to an outer surface of the telescoping tube.

11 Claims, 13 Drawing Sheets

TELESCOPING VENTILATION HOOD

FIELD

The disclosed technology relates to a telescoping ventilation hood device for a grill, and more particularly, to a hood device having a hood, a first grease collector, a telescoping tube, a grease filter box, a filter, a second grease collector, and at least two spring balancers.

BACKGROUND

Many restaurants, and especially Korean barbecue restaurants, cook food on a grill, roaster, or stove at a dining table to serve warm dishes and keep food warm. These restaurants often install hood devices above each table for ventilating cooking fumes, smokes, odors, and the like from the grill, and to draw grease and dirt out of the fumes and smoke using a filter. Conventional hood devices include an exhaust hood that is mounted on a ceiling or a wall and above a grill. However, a ceiling or wall-mounted hood may not be able to completely exhaust the smoke and odors from the grill due to the relatively large distance between the grill and the hood. As a result, customers and restaurant workers can be exposed to high levels of cooking oil fumes and smoke.

Some hood devices with telescoping pipes have been developed to address the above problem. In general, a telescoping pipe permits the hood to be lowered so that the intake of the pipe is close to the food being grilled, allowing the hood device to more effectively collect the smoke. See, e.g., U.S. Pat. No. 8,079,359; US 2020/0107677. However, some such devices are raised and lowered using a wire rope positioned inside the telescoping tubing, which can undesirably accumulate grease, dirt, and debris that are not filtered from the smoke of the grill. The accumulated grease, dirt, and debris can prevent the telescoping tubing from smoothly raising or lowering the hood, and can reduce the durability of the wire rope. Also, devices having concentric and cylindrical filtering layers of a filter assembly are relatively inefficient in collecting grease, dirt, or debris. Additionally, devices having a grease cup disposed at the bottom of the filter assembly tend to be bulky and excessively protrude from the hood. Thus, a grease cup that occupies vertical space between the hood and grill can prevent the hood from getting sufficiently close to the grill. Devices having a filter assembly and grease cup sitting within the hood can also undesirably increase the overall weight of the hood, which can interfere with the smooth movement of the telescoping tubing.

Given the foregoing, there is a need for an improved, durable telescoping ventilation hood device that can be smoothly and conveniently raised or lowered close to a grill, with a filtering system that can efficiently filter out grease, dirt and the like from smoke without interfering with the smooth movement of the hood.

SUMMARY

The disclosed technology relates generally to a telescoping ventilation hood device, such as for use in restaurants and other locations where food is cooked on a grill, roaster, stove, and the like at a dining table, in order to ventilate cooking fumes, smoke, odors, etc. from the vicinity of the dining table.

In one aspect, the disclosed technology relates to a telescoping ventilation hood device for a grill, including: a hood configured to be positioned above the grill; a first grease collector attached to the hood; a telescoping tube including a first portion, and a second portion connected to the hood and configured to telescopically engage the first portion so that the second portion can translate in relation to the first portion in a longitudinal direction of the telescoping tube and a distance between the hood and the grill can be varied; a grease filter box connected to the first portion of the telescoping tube; a filter configured to be removably mounted within the grease filter box in an angled orientation with respect to a gravitational direction; a second grease collector configured to be removably mounted within the grease filter box; and a first and a second spring balancer mounted on the first portion of the telescoping tube and each including a wire connected to the second portion of the telescoping tube, the first and second spring balancers being configured to exert a respective first and second force on the second portion of the telescoping tube, the first and second forces biasing the second portion of the telescoping tube in the longitudinal direction of the telescoping tube.

In some embodiments, the first and second forces on the second portion of the telescoping tube stabilize a position of the second portion in relation to the grill. In some embodiments, the hood device further includes a first wire receiving member mounted on the second portion of the telescoping tube directly below the first spring balancer; and a second wire receiving member mounted on the second portion of the telescoping tube directly below the second spring balancer; wherein the wire of the first spring balancer is connected to the first wire receiving member, and the wire of the second spring balancer is connected to the second wire receiving member. In some embodiments, the first spring balancer includes a body, and the wire of the first spring balancer is configured to retract into the body, and to extend from the body in the longitudinal direction of the telescoping tube; and the second spring balancer includes a body, and the wire of the second spring balancer is configured to retract into the body of the second spring balancer, and to extend from the body of the second spring balancer in the longitudinal direction of the telescoping tube.

In some embodiments, the first and second spring balancers are located in diametrically opposite positions on an outer periphery of the first portion of the telescoping tube. In some embodiments, the first spring balancer is configured to generate a tensile force on the wire of the first spring balancer in response to the extension of the wire of the first spring balancer from the body of the first spring balancer; the first force is approximately equal to the tensile force on the first wire; the second spring balancer is configured to generate a tensile force on the wire of the second spring balancer in response to the extension of the wire of the second spring balancer from the body of the second spring balancer; and the second force is approximately equal to the tensile force on the second wire.

In some embodiments, the wire of the first spring balancer and the wire of the second spring balancer are aligned non-coaxially with a longitudinal axis of the telescoping tube. In some embodiments, the grease filter box includes an access door; the telescoping ventilation hood device further includes filter receiving parts attached to inner side surfaces of the grease filter box; the filter is mounted on the filter receiving parts; and the grease filter box has a bottom opening formed therein and configured to permit smoke from the telescoping tube to enter the grease filter box. In some embodiments, the filter includes a frame and at least two substantially parallel layers of longitudinally extending strips; the strips extend between sides of the frame; each strip is slanted with respect to the gravitational direction and has inwardly bent sides; at least one of the bent sides of the strips in one layer faces and overlaps the strips in the other layer; and the frame has drain holes formed along a lower side thereof and configured to direct grease to the second grease collector in the grease filter box.

In some embodiments, the frame has drain holes formed along an upper side thereof whereby an orientation of the filter can be reversed. In some embodiments, the first grease collector is configured to be secured to the hood by a twist lock. In some embodiments, the first grease collector includes a peripheral recess extending inwardly from a peripheral edge thereof. In some embodiments, the hood device further includes a handle mounted on one of a lower portion of the telescoping tube and the hood.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description. These and other features, aspects and advantages of the disclosed technology will become better understood with reference to the accompanying drawings.

DETAILED DESCRIPTION

Figure 1A:
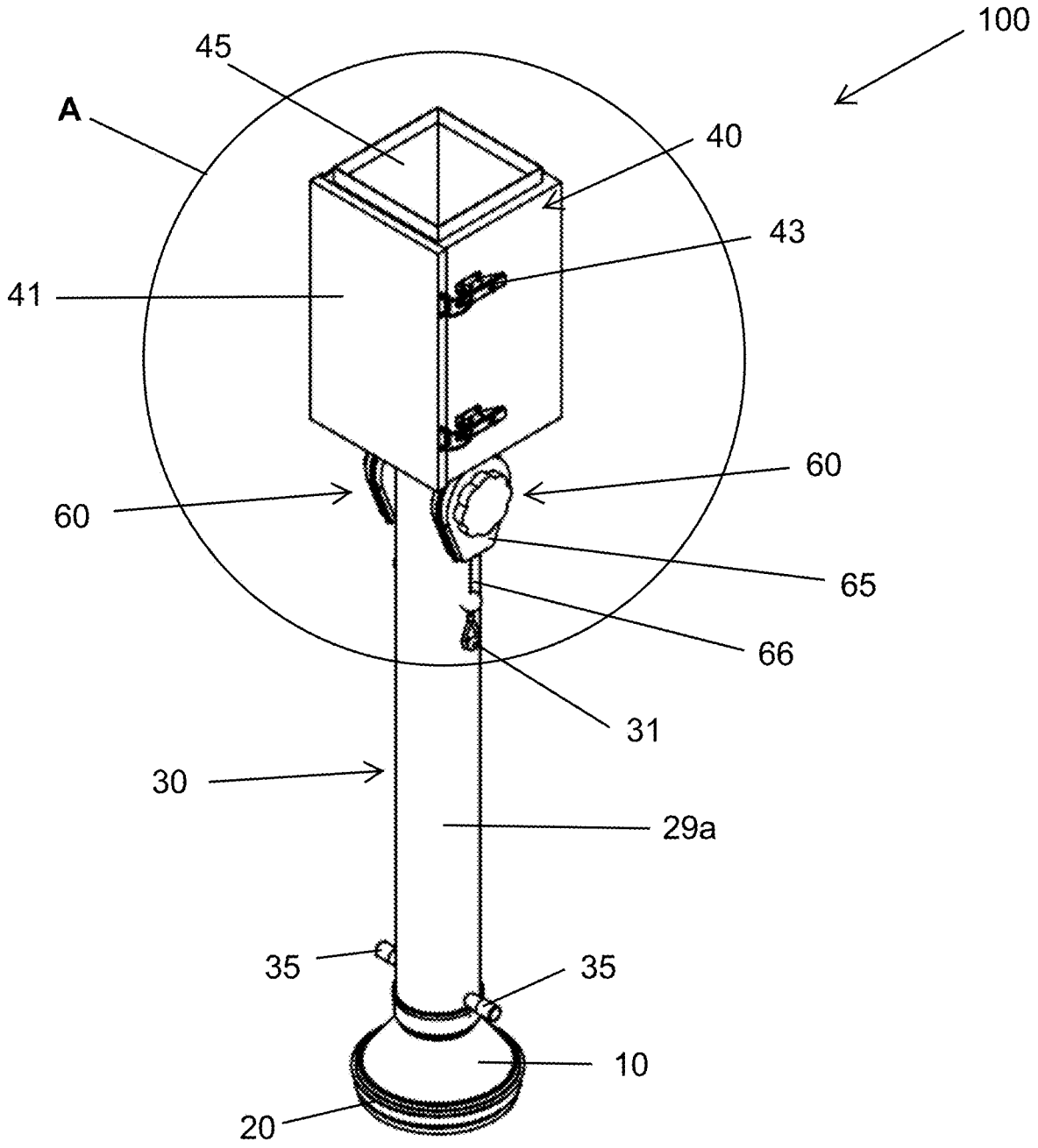
FIG. 1A is a top perspective view of a hood device for a grill, depicting an outer portion of a telescoping tube of the device in a raised position.
Figure 1B:
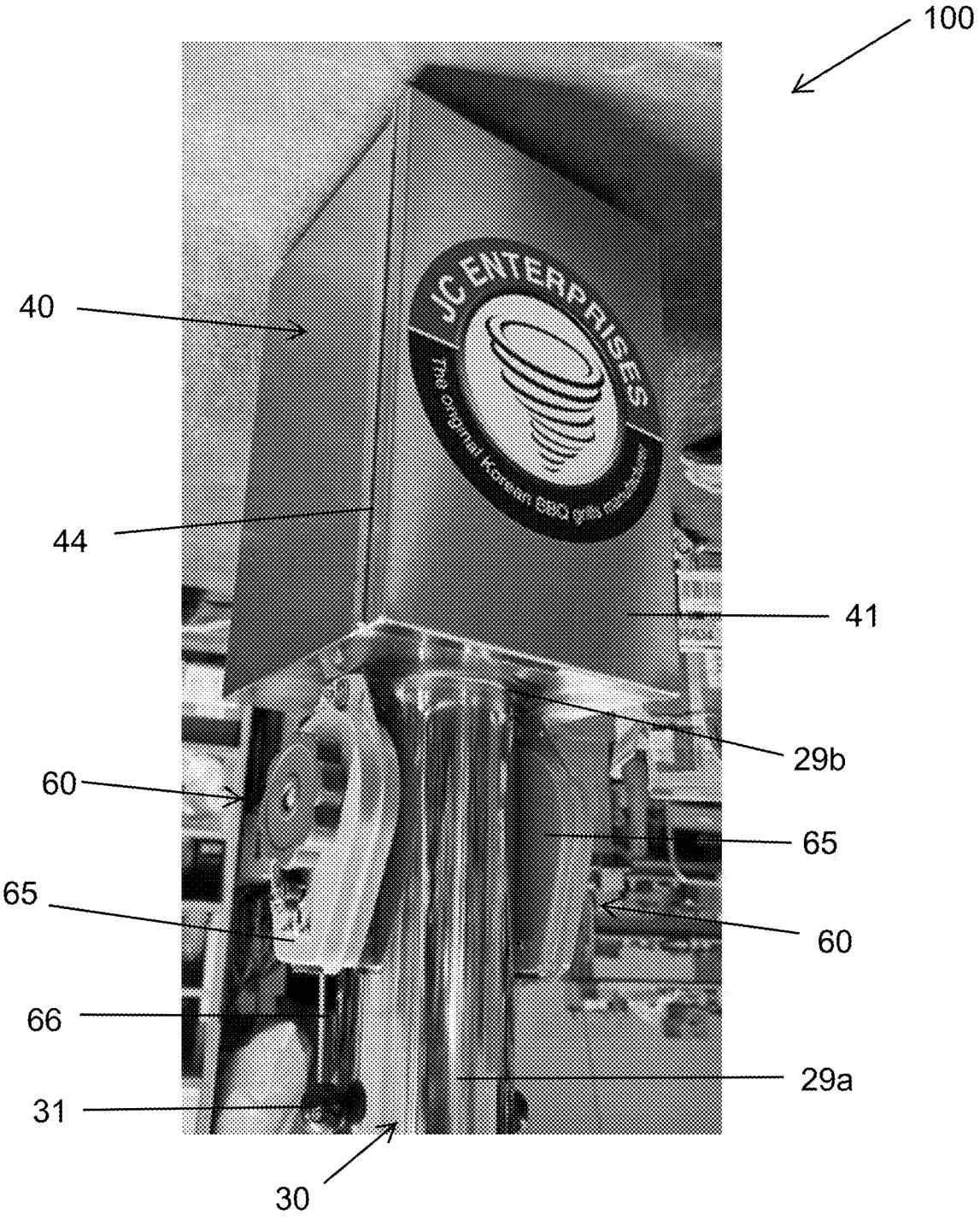
FIG. 1B is a bottom-side, magnified perspective view of the area designated "A" in FIG. 1A.
Figure 2:
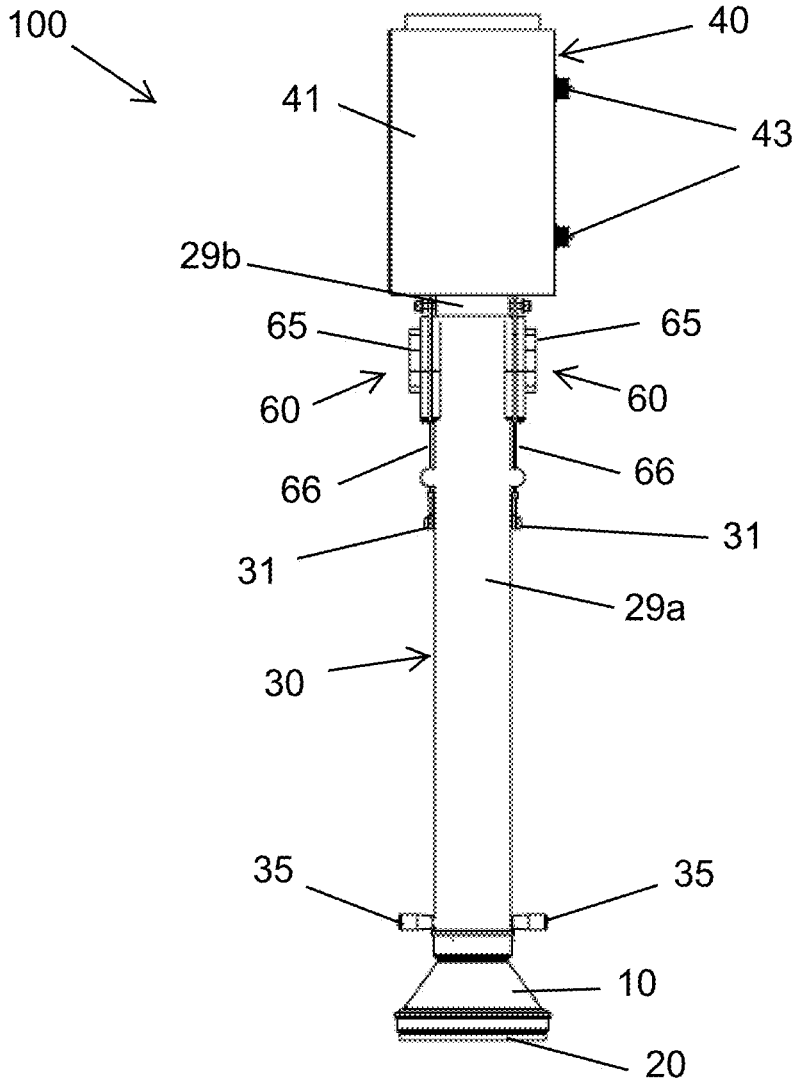
FIG. 2 is a side view of the hood device shown in FIGS. 1A and 1B, depicting the outer portion of the telescoping tube in the raised position.

The following discussion omits or only briefly describes conventional features of the disclosed technology that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the disclosed technology, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

The devices of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. All spatial references, such as, for example, proximal, distal, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior."

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled. The figures depict a telescoping ventilation hood device 100 for a grill (not shown).

Referring to FIGS. 1A-4, the hood device 100 comprises a hood 10, a first grease collector 20, a telescoping tube 30, a grease filter box 40, a filter 50, a second grease collector 55, and a first and a second spring balancer. The first and second spring balancers are substantially identical, and are denoted by the refence character 60.

The telescoping tube 30 comprises a plurality of tubular portions that are telescopically combined to facilitate adjustment of distance between the hood 10 and the grill. In the disclosed embodiment, the telescoping tube 30 includes a first or inner portion 29*b* and a second or outer portion 29*a*. The inner portion 29*b* is telescopically and concentrically disposed within the outer portion 29*a*, i.e., the outer portion 29*a* telescopically engages the inner portion 29*b*. Alternative embodiments of the telescoping tube 30 can include more than two telescoping portions.

As shown in FIGS. 1A-4 and 11, a first or lower end of the hood 10 is connected to the first grease collector 20. The first grease collector 20 is configured to collect condensed grease, dirt, and the like flowing from internal surfaces of the hood 10 and the telescoping tube 30. A second or upper end of the hood 10 is securely connected to a lower end of the outer portion 29*a* of the telescoping tube 30, so that the hood 10 translates with the outer portion 29*a* as the outer portion 29*a* translates telescopically in relation to the inner portion 29*b*. An upper end of the inner portion 29*b* of the telescoping tube 30 is securely connected to the grease filter box 40, so that smoke, fumes, and odors generated by the heating of food on the grill enter the grease filter box 40 after traveling through the hood 10 and the telescoping tube 30.

The outer portion 29*a* of the telescoping tube 30, and the attached hood 10, translate in relation to the inner portion 29*b* in a direction coinciding with the longitudinal axis of the telescoping tube 30. The outer portion 29*a* can translate between a raised, or retracted position shown in FIGS. 1A, 1B, and 2; and a lowered or extended position shown in FIG. 4. Due to the telescoping action of the telescoping tube 30, the hood 10 can be lowered to a position that is relatively close to the grill, so that the hood 10 more effectively can draw cooking fumes, smokes, odors and the like that are generated by the cooking of food on the grill. The ability to move the hood 10 close to the grill allows the hood 10 to be smaller in diameter than conventional hoods, without impacting the ability of the hood 10 to draw in smoke, fumes, and odors. When cooking is completed and the fumes, smokes, and odors have been eliminated by the hood device 100, the outer portion 29*a* of the telescoping tube 30 can be lifted along with the hood 10 so that the user can access the cooked food more easily, and to permit the dining space to be cleaned more easily.

The distance by which the telescoping tube 30 can be extended or shortened depends on the height or distance by which the outer and inner portions 29*a*, 29*b* overlap. The minimum overlap between the outer portion 29*a* and the inner portion 29*b* can be, for example, about ten inches. Also, the overall combined height of the telescoping tube 30, the hood 10, and the first grease collector 20 can vary. In some embodiments, when the outer portion 29*a* is in its lowered position, this overall height may be from about 42 inches to about 54 inches, about 44 inches to about 52 inches, or about 46 inches to about 48 inches. In some embodiments, when the outer portion 29*a* is in its raised position, this overall height may be from about 40 inches to about 70 inches, about 45 inches to about 65 inches, or about 48 inches to about 60 inches. In some embodiments, the height of the first grease collector 20 is about 10 inches to about 14 inches, such as about 12 inches. In some embodiments, the overall combined height of the telescoping tube and the hood 10 may be configured to range from about 30 inches to about 52 inches, from about 32 inches to about 50 inches, from about 34 inches to about 48 inches, or any variation thereof.

In some embodiments, the outermost diameter of the telescoping tube 30 is about 5 inches to about 10 inches, about 6 inches to about 9 inches, or about 7 inches to about 8 inches. The hood 10 has an outermost diameter that is greater than the outermost diameter of the telescoping tube 30. For instance, the hood 10 outermost diameter may be at least about 2 inches, at least about 3 inches, at least about 4 inches, at least about 5 inches, or at least about 6 inches greater than the outermost diameter of the telescoping tube 30.

As can be seen in FIGS. 1A-4, insulated handles 35 can be mounted near the lower end of the outer portion 29*a* of the telescoping tube 30. The handles 35 can be grasped by the user to raise or lower the telescoping tube 30. The insulated handles 35 can be mounted on the hood 10 in alternative embodiments.

The first and second spring balancers 60 are configured to exert a respective first and second force on the outer portion 29*a* of the telescoping tube 30, and bias the outer portion 29*a* in the longitudinal direction of the telescoping tube 30. Referring to FIGS. 1A-4 and 12, the spring balancers 60 are attached to an outer surface of the inner portion 29*b* of the telescoping tube 30, proximate the upper end of the inner portion 29*b*. The spring balancers 60 can be located at diametrically opposed positions along the outer periphery of the inner portion 29*b*. Each of the spring balancers 60 comprises a wire 66. Each wire 66 is connected to a respective first and second wire receiving member attached to the outer portion 29*a* of the telescoping tube 30, proximate the upper end of the outer portion 29*a* and directly below the associated spring balancer 60. The first and second wire receiving members are substantially identical, and are denoted by the reference character 31. Thus, the wires 66 are located outside of the telescoping tube 30, and are aligned non-coaxially with a longitudinal axis of the telescoping tube 30.

When the outer portion 29*a* is lifted or lowered in response to an applied force, the spring balancers 60 each generate a tensile force in their associated wire 66 in response to the extension of the wire 66 from the body 65 of the spring balancer 60. The spring balancers 60 stabilize, or support the telescoping tube 30 at a certain height that is determined by the applied force. Also, the spring balancers 60 can facilitate smooth longitudinal, i.e., vertical, movement of the outer portion 29*a* and the attached hood 10 in relation to the inner portion 29*b* of the telescoping tube 30 and the grease filter box 40. Alternative embodiments can include more than two of the spring balancers 60.

Figure 5:
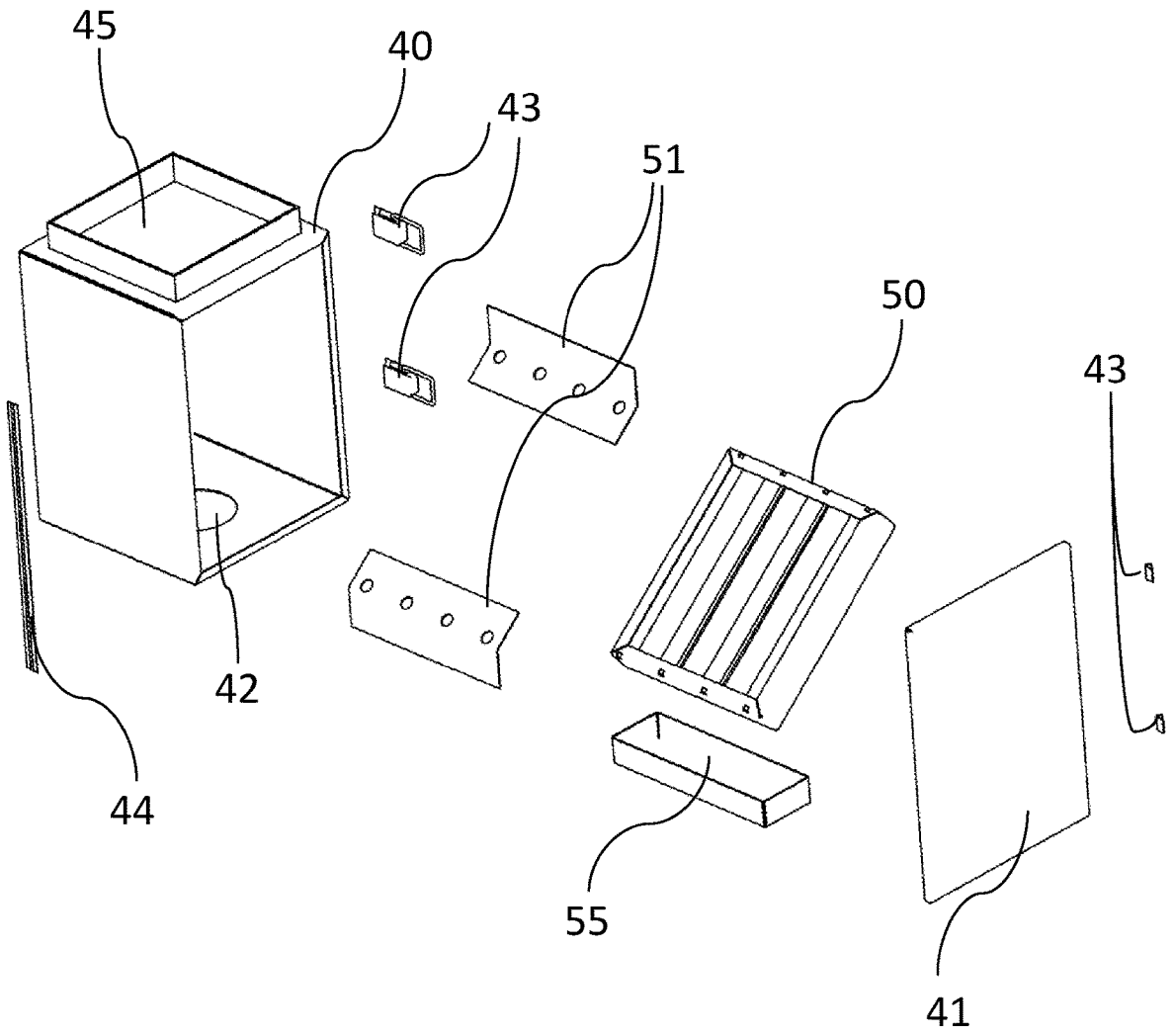
FIG. 5 is an exploded view of a grease filter box and a filter of the hood device shown in FIGS. 1A-4.
Figure 6:
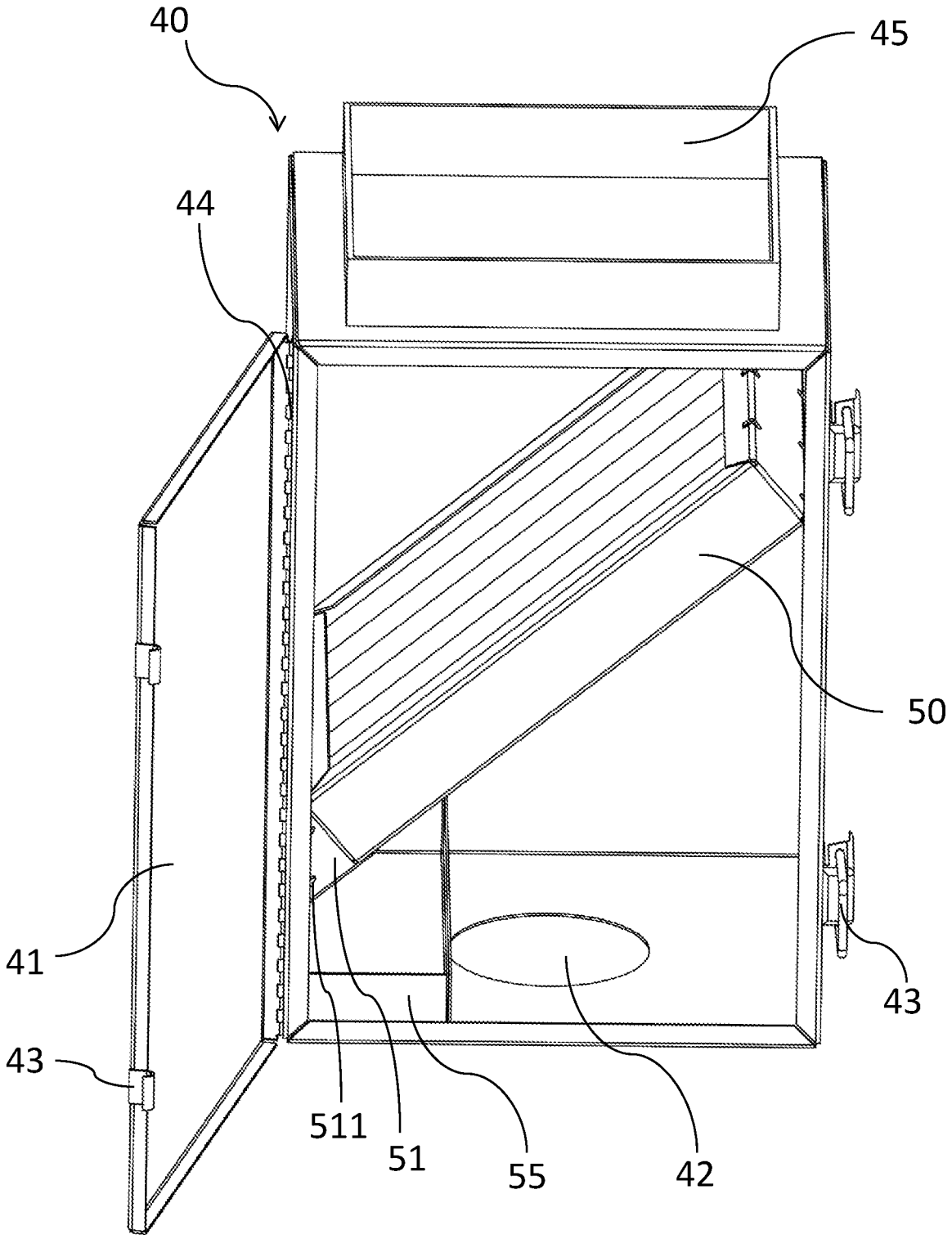
FIG. 6 is a perspective view of the grease filter box and the filter shown in FIG. 5, with the filter assembled within the grease filter box.

As shown in FIGS. 5 and 6, the grease filter box 40 is configured to removably receive the filter 50 and the second grease collector 55. The filter 50 can be slanted at a substantial angle with respect to a gravitational direction, i.e., the filter 50 can be mounted within the grease filter box 40 in an angled orientation in relation to the gravitational direction, and the second grease collector 55 may be disposed below a lower end of the filter 50. Thus, once smokes or exhaust fumes enter the grease filter box 40 through a bottom opening 42 of the grease filter box 40, any grease, dirt or debris that are contained in the fumes can be filtered out by the filter 50, and can be directed to the second grease collector 55 by gravity. In order to receive and maintain the filter 50 at its desired position within the grease filter box 40, filter receiving parts 51 may be provided on opposed inner side surfaces of the grease filter box 40. The filter 50 can be mounted on the filter receiving parts 51.

The presence of the filter 50 and the second grease collector 55 within the grease filter box 40 dispenses the need for a filter or a bulky grease collector positioned within the hood 10, which would consume a substantial amount of vertical space within the hood 10. Thus, the hood 10 can be lighter in weight, can be lowered more safely, and can be positioned closer to the grill in comparison to conventional hood devices. Moreover, the filter 50 and the second grease collector 55 are easily accessible and removable, and thus can be cleaned, maintained, and replaced with relative ease.

Referring to FIGS. 5 and 6, the grease filter box 40 may comprise an access door 41 to keep the filter 50 and the second grease collector 55 substantially isolated from the dining table. The grease filter box 40 thus can prevent grease, dirt, and debris that are collected in the grease filter box 40 from falling onto the dining table, thereby helping to maintain the dining area in a sanitary condition. The access door 41 is connected to the grease filter box 40 by a hinge 44, so that the access door 41 can be easily and smoothly opened and closed. The hinge 44 may comprise a piano hinge as shown, in order to provide better support for the access door 41, and to ensure the access door 41 and the grease filter box 40 remain aligned to reduce wear and tear. Alternatively, a plurality of short hinges may be used instead of the piano hinge 44. In addition, the grease filter box 40 may comprise locking means 43 to ensure that the access door 41 remains closed. Alternatively, a sliding door (not shown) can be used instead of the hinged door 41.

Figure 3:
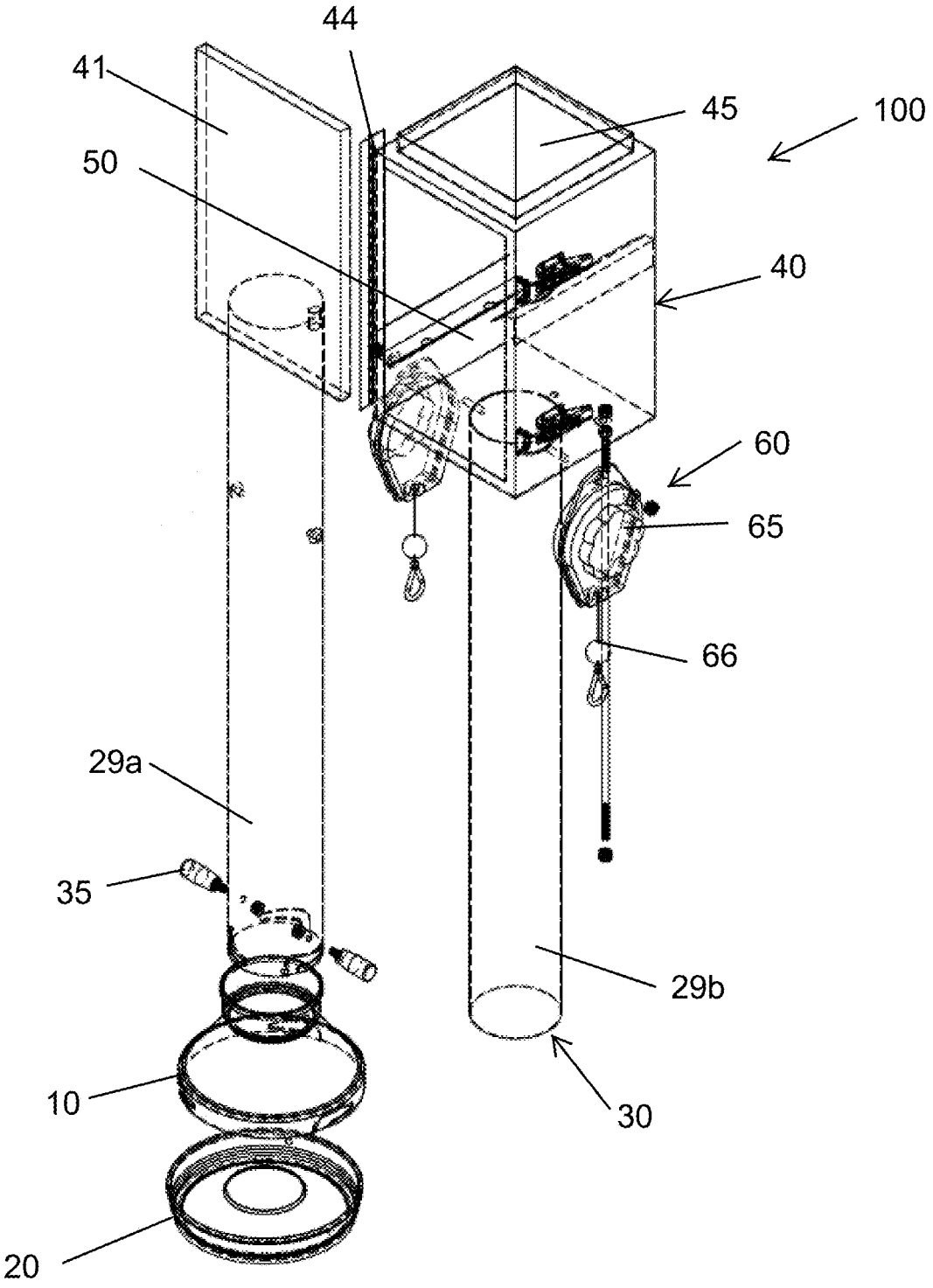
FIG. 3 is an exploded view of the hood device shown in FIGS. 1A, 1B, and 2.
Figure 4:
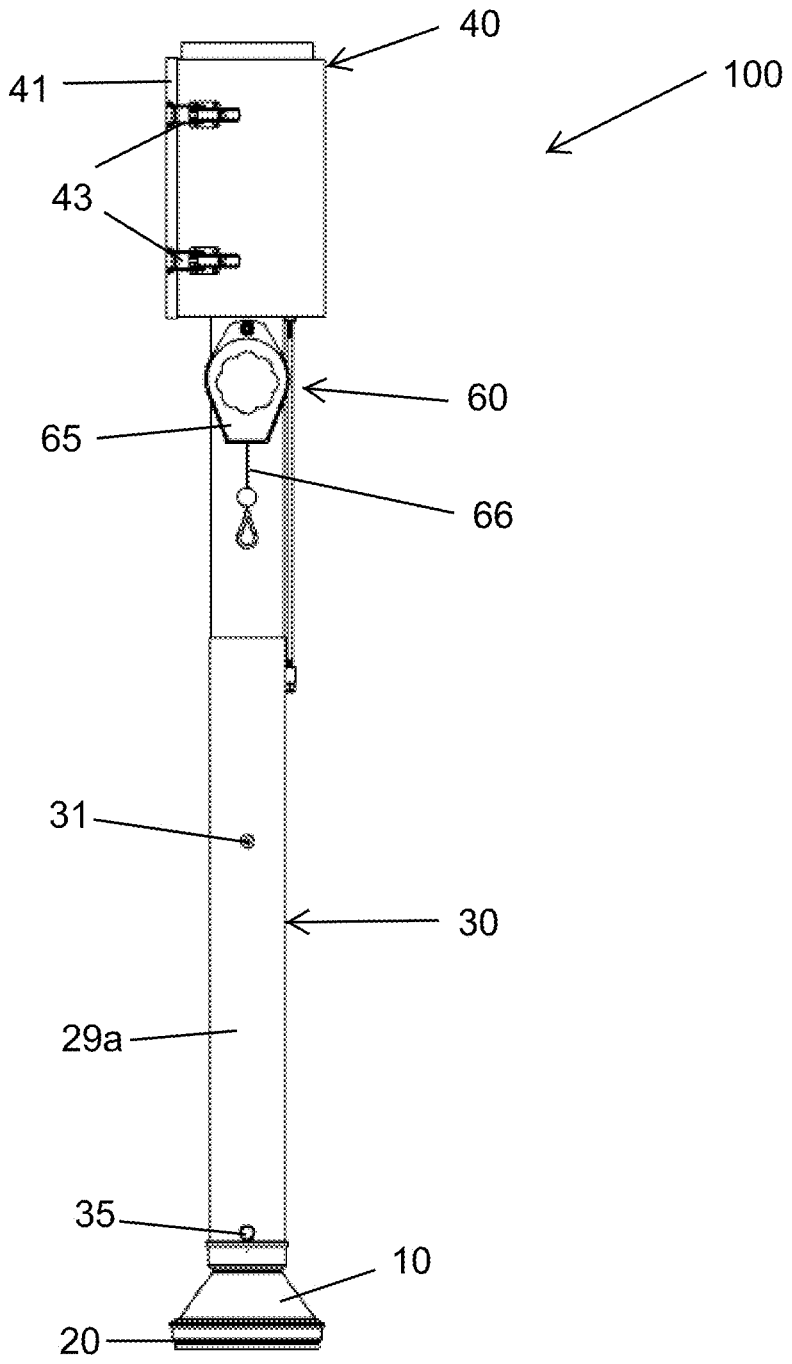
FIG. 4 is a side view of the hood device shown in FIGS. 1A-3, depicting the outer portion of the telescoping tube in a lowered position.

The grease filter box 40 may comprise an exhaust riser 45 on a top portion thereof, as shown in FIG. 3. Furthermore, a fire suppression system (not shown) may be provided within the grease filter box 40.

Figure 7:
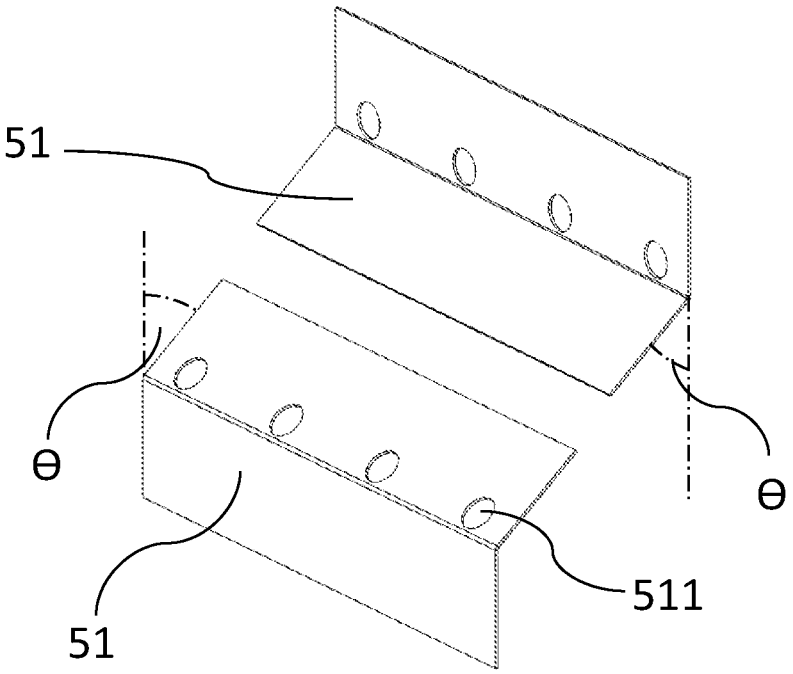
FIG. 7 is a perspective view of a filter receiving part of the hood device shown in FIGS. 1A-6.
Figure 8:
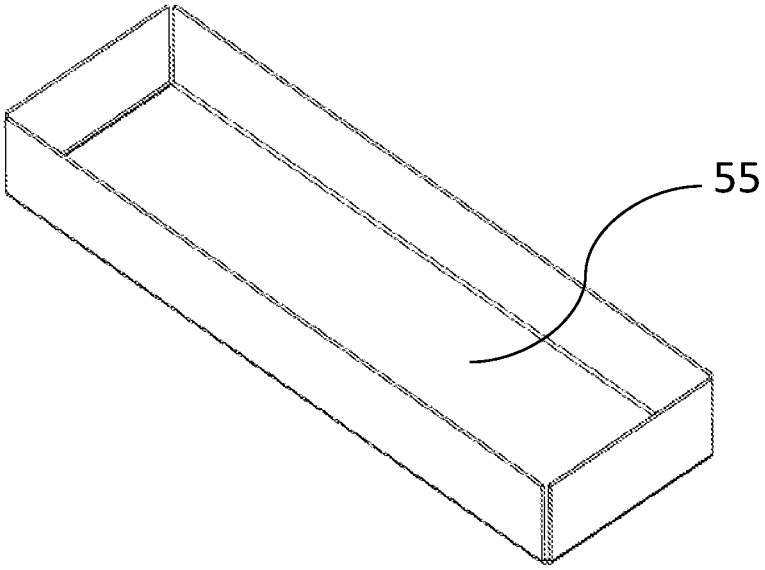
FIG. 8 is a perspective view of a second grease collector of the hood device shown in FIGS. 1A-7.

FIGS. 7 and 8 respectively illustrate filter receiving parts 51 and the second grease collector 55. An angle between the gravitational direction and the filter receiving parts 51 is denoted in FIG. 7 by the character θ. The angle θ may be, for example, about 45 degrees. Alternatively, the angle θ can be any angle between 0 to 90 degrees that causes grease, dirt, and debris to run along the slanted filter 50 and fall to the second grease collector 55 by gravitational force. The filter receiving parts 51 may have a plurality of holes 511 formed therein to allow grease, dirt, debris and the like to be drained away to the second grease collector 55. As shown in FIG. 8, the second grease collector 55 is a rectangular box. Alternatively, the second grease collector 55 may take any shape, size, or configuration that can trap and store the grease, dirt, debris and the like that are drained from the holes 511.

Figure 9:
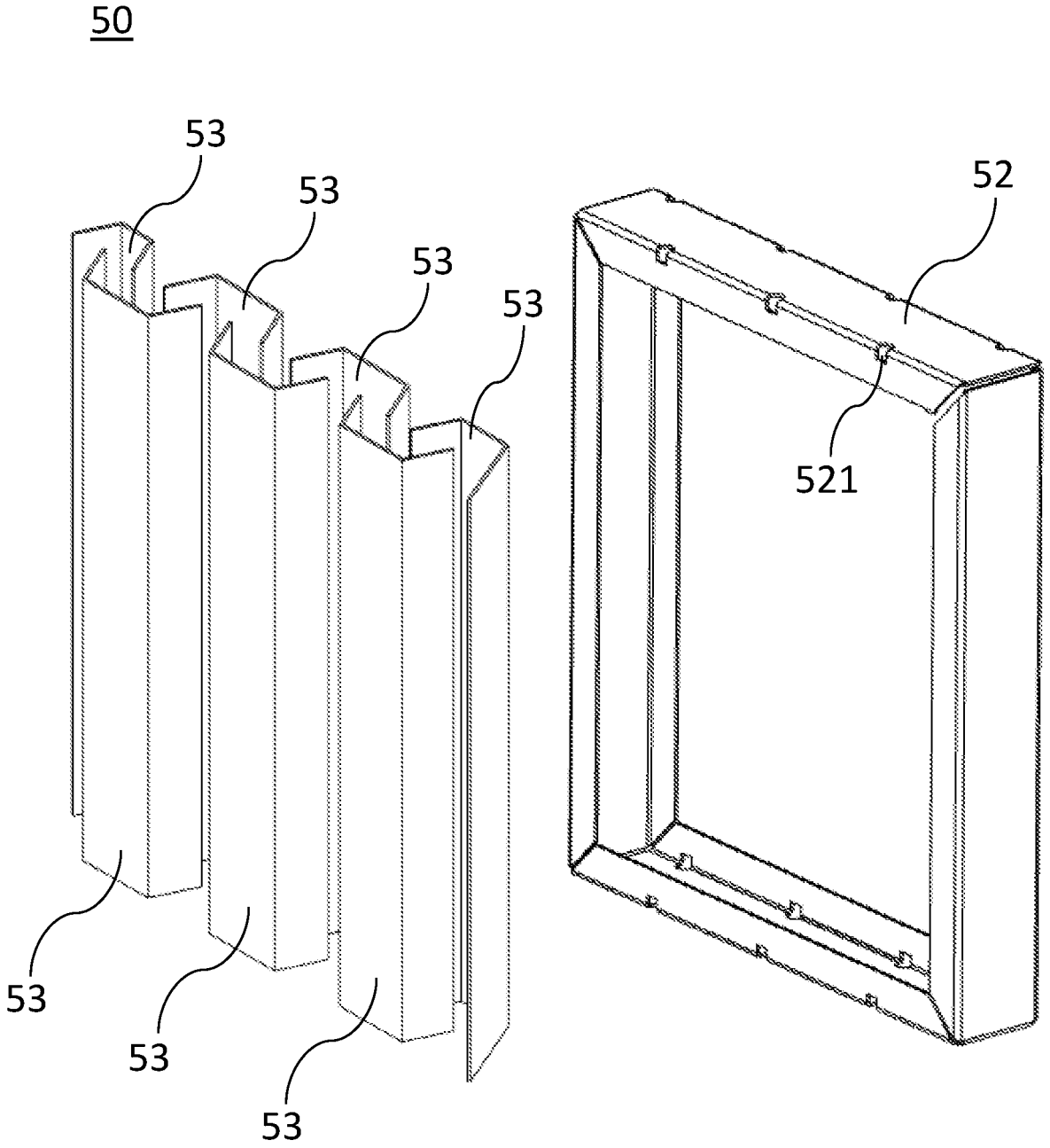
FIG. 9 is an exploded view of the filter shown in FIGS. 5 and 6.

The filter 50 is depicted in FIG. 9. The filter 50 may comprise a frame 52, and a plurality of longitudinally extending strips 53. The strips 53 can be configured in two substantially parallel layers extending between the sides of the frame 52. Each strip 53 has inwardly bent sides, and at least one bent side of the strips 53 in one layer faces, and overlaps the strips 53 in the other layer. A longitudinal axis of each strip 53 may be slanted with respect to the gravitational direction so that grease, dirt, debris and the like can run along the strips 53.

The frame 52 may have a plurality of drain holes 521 formed on a lower side thereof to direct grease, dirt, debris and the like to the second grease collector 55 in the grease filter box 40. As shown in FIG. 9, a plurality of drain holes 521 may be formed along an upper side of the frame 52 as well, so that the filter 50 can be used upside down, i.e., so that the up-down orientation of the filter 50 can be reversed. Furthermore, the drain holes 521 may be provided on both front and rear surfaces of the frame, so that the front-back orientation of filter 50 can be reversed.

Figure 10A:
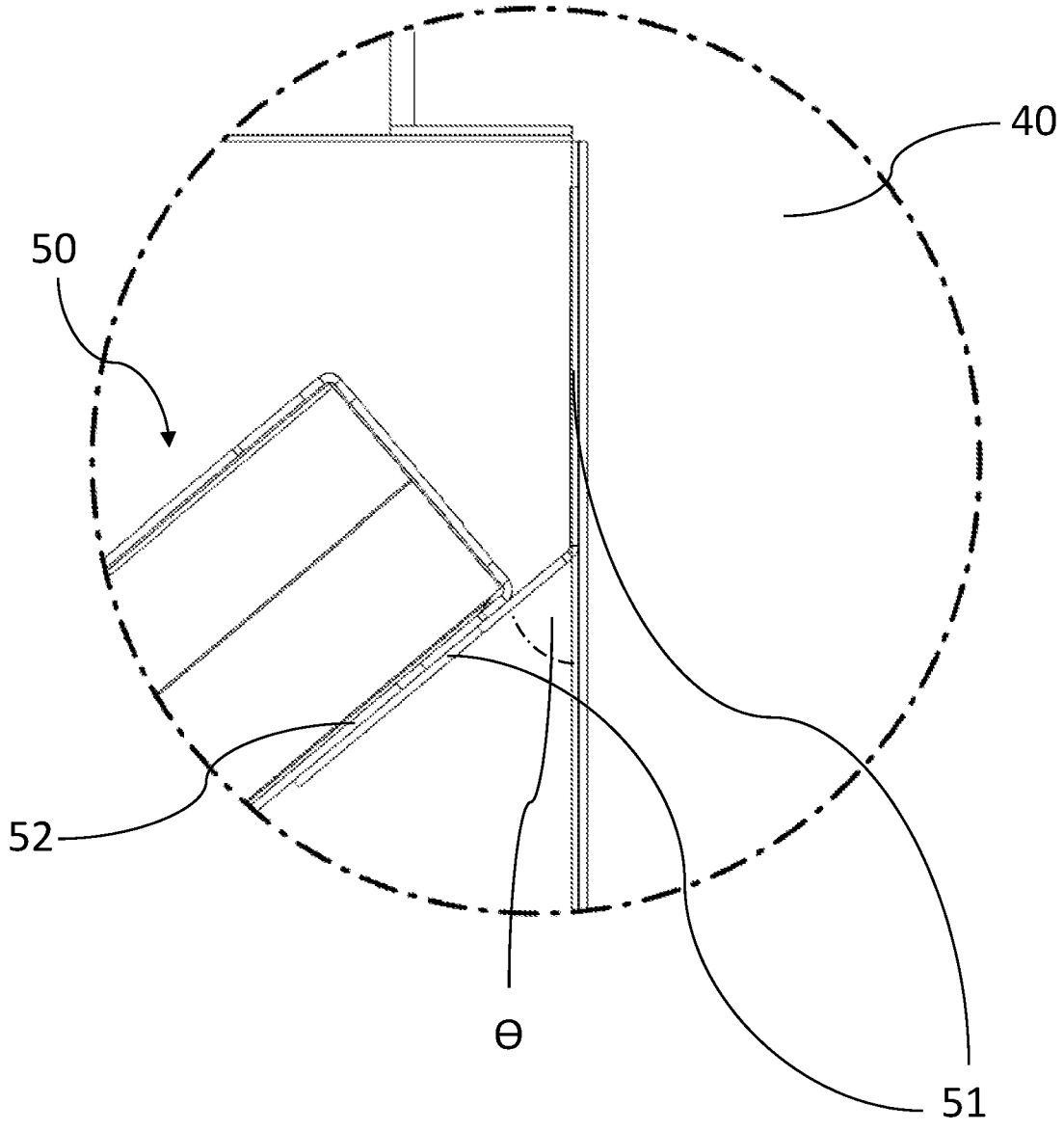
FIGS. 10A and 10B are enlarged views showing a filter receiving part and the filter shown in FIGS. 5, 6, and 9, installed in the grease filter box shown in FIGS. 5 and 6.
Figure 10B:
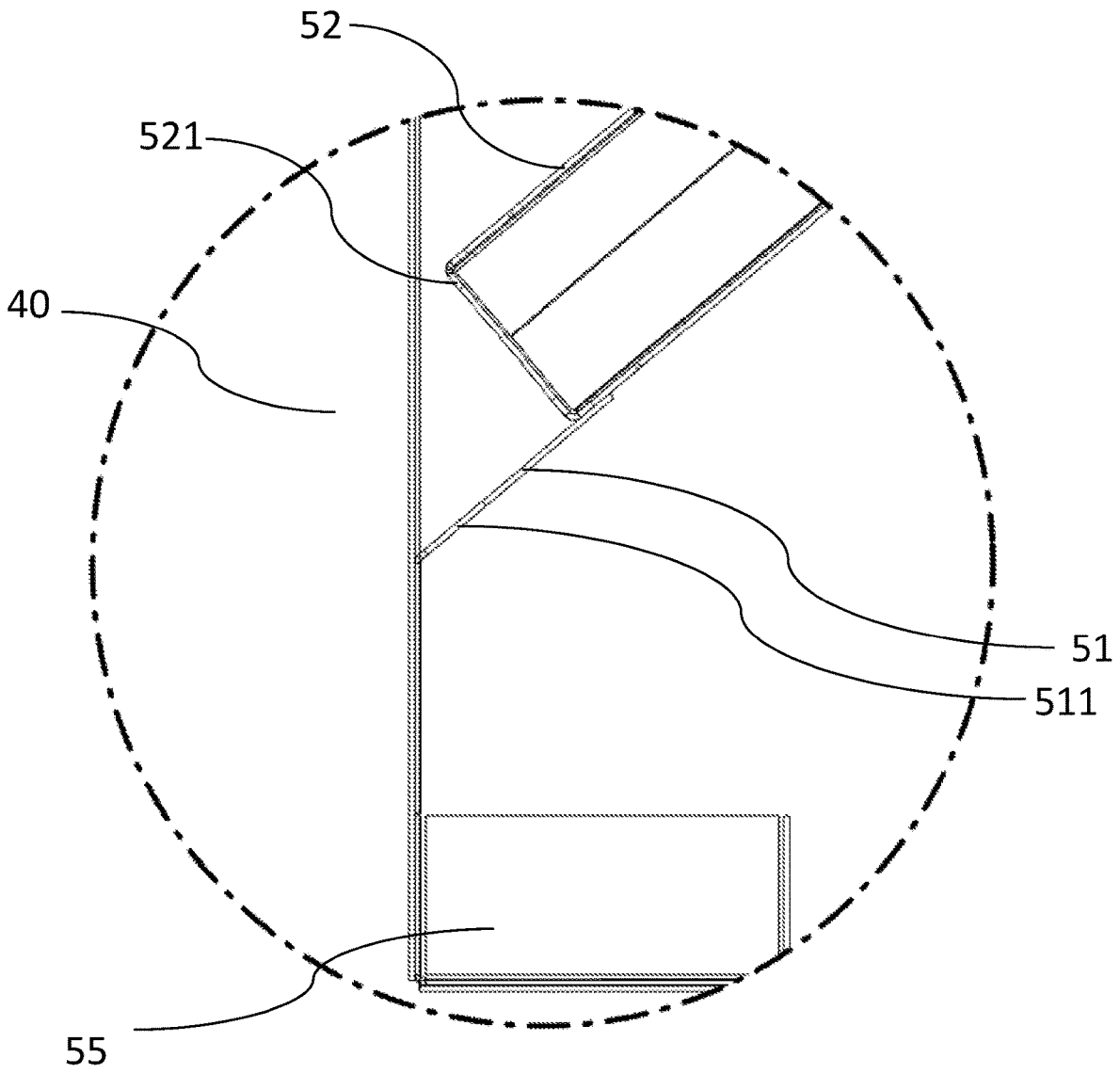

FIGS. 10A and 10B are enlarged views of the filter receiving parts 51 and the filter 50 in an assembled state. As shown in FIG. 10A, an upper side of the frame 52 is mounted on the filter receiving part 51 such that the filter 50 is slanted at a substantial angle θ with respect to the gravitational direction. In FIG. 10B, a lower side of the frame 52 is mounted on another filter receiving part 51, which is configured so that each drain hole 521 of the frame 52 is vertically aligned with a respective drain hole 511 of the filter receiving part 51. Thus, any grease, dirt, and debris and the like that are directed by the slanted strips 53 to the lower side of the frame 52 can be drained out of the drain hole 521 of the frame 52 and the drain hole 511 of the filter receiving part 51, and then can fall to the second grease collector 55 that is disposed below the filter 50.

Figure 11:
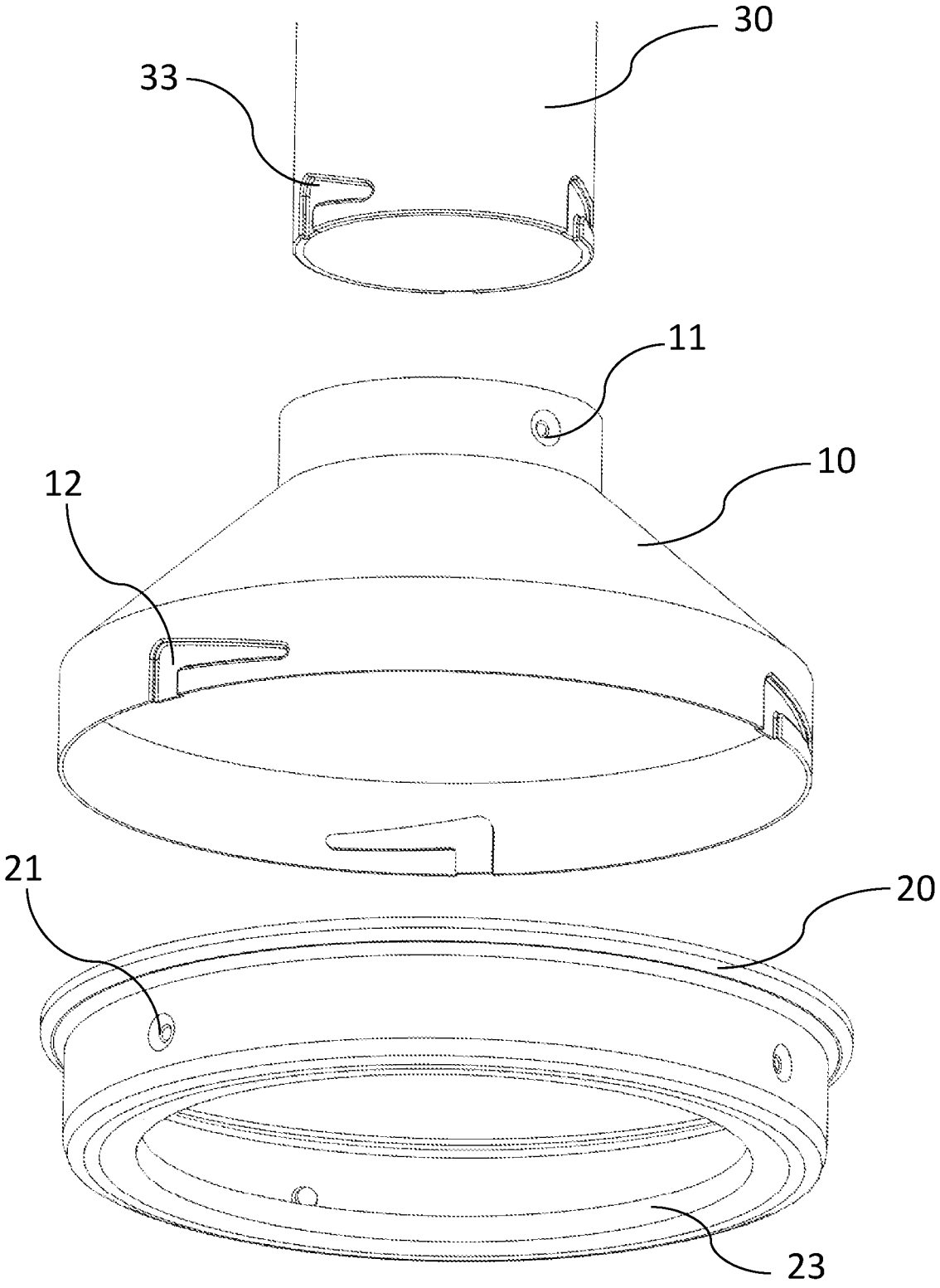
FIG. 11 is an exploded view of a telescoping tube, a hood, and a first grease collector of the hood device shown in FIGS. 1A-10.

FIG. 11 is an exploded view of the outer portion 29*a* of the telescoping tube 30, the hood 10, and the first grease collector 20. The hood 10 partially covers the grill at a certain distance from the grill, and takes in cooking fumes, smokes, odors and the like that are generated while by the cooking of food on the grill. The telescoping tube 30 is configured so that the hood 10 can be lowered to and positioned, for example, about 6 inches above the grill when the outer portion 29*a* of the telescoping tube 30 is in its lowered position. The telescoping tube 30 is configured so that the hood 10 can be lowered to and positioned at other distances above the grill in alternative embodiments. The hood 10 has a truncated cone shape. The hood 10 can be shaped as a truncated pyramid or a cylinder, or can have other suitable shapes, sizes, and configurations in alternative embodiments.

As shown in FIG. 11 and as discussed above, the first grease collector 20 may be attached to the hood 10. Although a majority of grease, dirt, debris and the like are collected by the second grease collector 55 in the grease filter box 40, there may be some residues condensed along internal surfaces of the telescoping tube 30 or the hood 10. The first grease collector 20 is provided along a periphery of the hood 10 to prevent such residues from falling onto the dining table below the hood device 100. The first grease collector 20 comprises a peripheral recess 23 extending inwardly from a peripheral edge thereof. Accordingly, any condensed grease flowing from internal surfaces of the telescoping tube 30 or the hood 10 can be collected by the peripheral recess 23. Therefore, the filter 50, the second grease collector 55, and the first grease collector 20 together can help to provide improved sanitation and more effective collection of grease.

The first grease collector 20 can be secured to the hood 10 by a twist lock. As shown in FIG. 11, the first grease collector 20 comprises locking protrusions 21, and the hood 10 comprises locking grooves 12 formed in a lower portion thereof. Alternatively, the first grease collector 20 can comprise the locking grooves 12, and the hood 10 can comprise the locking protrusions 21. In both configurations, each locking protrusion 21 is configured to be connected to a respective locking groove 12.

Similarly, as also shown in FIG. 11, the hood 10 further comprises locking protrusions 11 at an upper portion thereof, and the outer portion 29*a* of the telescoping tube 30 comprises locking grooves 33. Alternatively, the hood 10 can comprise the locking grooves 33, and the telescoping tube 30 can comprise the locking protrusions 11. In both configurations, each locking protrusion 11 is configured to be connected to a respective locking groove 33.

The twist lock structure can permit safer and easier assembly and disassembly of the hood device 100 for maintenance. A rotational screw closure (not shown) can be used in lieu of the twist lock in alternative embodiments.

Figure 12:
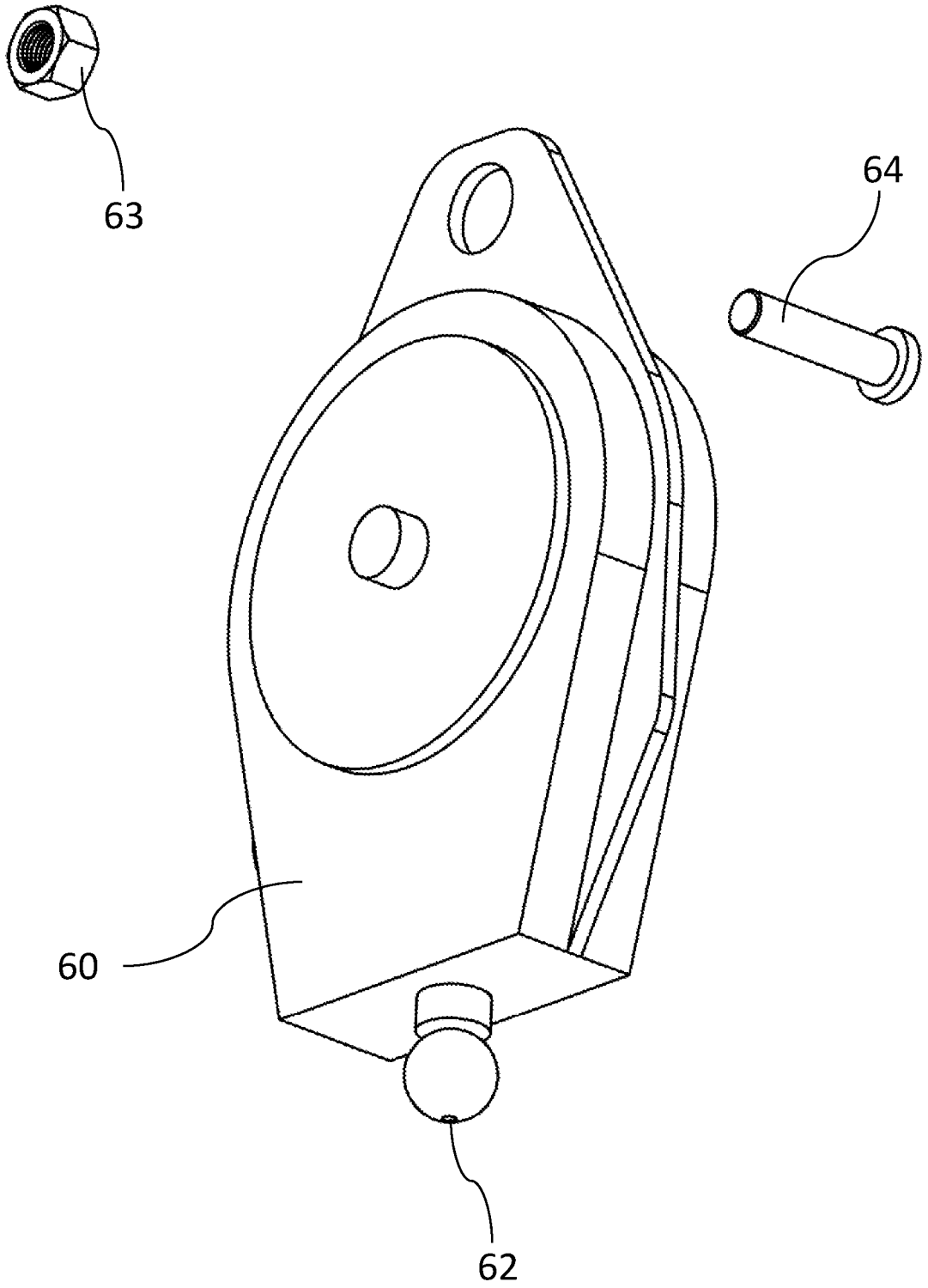
FIG. 12 is a perspective view of a spring balancer of the hood device shown in FIGS. 1A-11.

FIG. 12 illustrates one of the spring balancers 60. Each of the spring balancers 60 is attached the inner portion 29*b* of the telescoping tube 30 by way of a lock nut 63 and bolt 64. Alternatively, a wing nut, or other suitable means of attaching the spring balancers 60 to the inner portion 29*b* can be used in the alternative. Each spring balancer 60 comprises a body 65, and the wire 66 that retracts into, and coils within the body 65. The wire 66 exits the body 65 by way of an opening in the body 65. The wire 66 is connected to the associated wire receiving member 31 mounted on the outer portion 29*a* of the telescoping tube 30, so as to facilitate smooth longitudinal movement of the telescoping tube 30, and to maintain or suspend the telescoping tube 30 at a certain distance from the grill. Because the wires 66 are located externally to the telescoping tube 30, grease present in the smoke within the telescoping tube 30 does not accumulate on the wires 66. Such grease, were it to accumulate on the wires 66, could hinder the smooth extension and retraction of the telescoping tube 30, and could adversely impact the durability of the wires 66.

If the telescoping tube 30 were to be supported by a spring balancer 60 from only one side, the wire 66 of the spring balancer 60 may create a torque or side force on the telescoping tube 30, which in turn could cause the telescoping tube 30 to swing, sway, or rock from side to side as the outer portion 29*a* and the attached hood 10 are raised and lowered. The use of two spring balancers 60, positioned on opposite sides of the inner portion 29*b*, helps to minimize or eliminate such swinging, swaying, and rocking movement, and can eliminate the need for additional hardware to stabilize the telescoping tube 30.

Also, as shown in FIGS. 1A, 1B, 2, and 4, each spring balancer 60 is located directly above the associated wire receiving member 31 that couples wire 66 of spring balancer 60 to the outer portion 29*a* of the telescoping tube 30. Thus, the wire 66, after exiting the spring balancer 60, is vertically oriented. Substantially all of the force exerted by each spring balancer 60 and its associated wire 66 on the outer portion 29*a* therefore acts vertically, in the direction of movement of the outer portion 29*a*, i.e., substantially all of the force exerted by the spring balancer 60 is used to help lift and suspend the outer portion 29*a* and the attached hood 10.

By contrast, mounting the spring balancers 60 at locations that are not directly above their associated receiving member 31, such as the sides of the grease filter box 40, would cause each wire 66 to approach its associated wire receiving member 31 at an angle. Thus, a portion of the force exerted by the spring balancers 60 would act in a direction other than the vertical direction, i.e., a portion of the force would not help to lift and suspend the outer portion 29*a* and the attached hood 10, necessitating the use of larger spring balancers 60 than otherwise would be required, or potentially resulting in inadequate force to properly suspend the outer portion 29*a* of the telescoping tube 30. Also, because the wire 66 would exit and contact the body 65 at an angle, the wire 66 would be susceptible to wear, chafing, and tangling.

The hood 10, telescoping tube 30, first grease collector 20, and second grease collector 55 can be made of stainless steel. The filter 50, including the frame 52 and the strips 53, can be made of galvanized steel. The insulated handle 35 can be made of phenol. In alternative embodiments, the above-mentioned components of the hood device 100 can be made from other strong materials that can withstand heat from the grill.

The present disclosure is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

All references cited and/or discussed in this specification are incorporated herein by reference in their entireties and to the same extent as if each reference was individually incorporated by reference.

What is claimed is:

1. A telescoping ventilation hood device for a grill, comprising:

a hood configured to be positioned above the grill;

a first grease collector attached to the hood;

a telescoping tube comprising a first portion, and a second portion connected to the hood and configured to telescopically engage the first portion so that the second portion can translate in relation to the first portion in a longitudinal direction of the telescoping tube and a distance between the hood and the grill can be varied;

a grease filter box connected to an upper end of the first portion of the telescoping tube;

a filter configured to be removably mounted within the grease filter box in an angled orientation with respect to a gravitational direction;

a second grease collector configured to be removably mounted within the grease filter box;

a first and a second spring balancer mounted on the upper end the first portion of the telescoping tube and each comprising a wire connected to the second portion of the telescoping tube, the first and second spring balancers being configured to exert a respective first and second force on the second portion of the telescoping tube, wherein the first and second forces bias the second portion of the telescoping tube in the longitudinal direction of the telescoping tube and stabilize a position of the second portion in relation to the grill;

a first wire receiving member mounted on the second portion of the telescoping tube directly below the first spring balancer and spaced from an upper edge of the second portion of the telescoping tube by a distance greater than a vertical dimension of the first spring balancer; and a second wire receiving member mounted on the second portion of the telescoping tube directly below the second spring balancer and spaced from the upper edge of the second portion of the telescoping tube by a distance greater than a vertical dimension of the second spring balancer; wherein:

the wire of the first spring balancer is connected to the first wire receiving member;

the wire of the second spring balancer is connected to the second wire receiving member; and the second portion of the telescoping tube is configured to move vertically between a lower position, and an upper position at which the upper edge of the second portion of the telescoping tube has a height about equal to a height of the upper end of the first portion of the telescoping tube.

2. The hood device of claim 1, wherein:

the first spring balancer comprises a body, and the wire of the first spring balancer is configured to retract into the body, and to extend from the body in the longitudinal direction of the telescoping tube; and the second spring balancer comprises a body, and the wire of the second spring balancer is configured to retract into the body of the second spring balancer, and to extend from the body of the second spring balancer in the longitudinal direction of the telescoping tube.

3. The hood of claim 2, wherein:

the first spring balancer is configured to generate a tensile force on the wire of the first spring balancer in response to the extension of the wire of the first spring balancer from the body of the first spring balancer;

the first force is approximately equal to the tensile force on the first wire;

the second spring balancer is configured to generate a tensile force on the wire of the second spring balancer in response to the extension of the wire of the second spring balancer from the body of the second spring balancer; and the second force is approximately equal to the tensile force on the second wire.

4. The hood of claim 1, wherein the first and second spring balancers are located in diametrically opposite positions on an outer periphery of the first portion of the telescoping tube.

5. The hood device of claim 1, wherein the wire of the first spring balancer and the wire of the second spring balancer are aligned non-coaxially with a longitudinal axis of the telescoping tube.

6. The hood device of claim 1, wherein:

the grease filter box comprises an access door;

the telescoping ventilation hood device further comprises filter receiving parts attached to inner side surfaces of the grease filter box;

the filter is mounted on the filter receiving parts; and the grease filter box has a bottom opening formed therein and configured to permit smoke from the telescoping tube to enter the grease filter box.

7. The hood device of claim 1, wherein:

the filter comprises a frame and at least two substantially parallel layers of longitudinally extending strips;

the strips extend between sides of the frame;

each strip is slanted with respect to the gravitational direction and has inwardly bent sides;

at least one of the bent sides of the strips in one layer faces and overlaps the strips in the other layer; and the frame has drain holes formed along a lower side thereof and configured to direct grease to the second grease collector in the grease filter box.

8. The hood device of claim 7, wherein the frame has drain holes formed along an upper side thereof whereby an orientation of the filter can be reversed.

9. The hood device of claim 1, wherein the first grease collector is configured to be secured to the hood by a twist lock.

10. The hood device of claim 1, wherein the first grease collector comprises a peripheral recess extending inwardly from a peripheral edge thereof.

11. The hood device of claim 1, further comprising a handle mounted on one of a lower portion of the telescoping tube and the hood.

* * * * *